United States Patent [19]

Hill

[11] 4,221,347

[45] Sep. 9, 1980

[54] ADJUSTABLE REEL FOR WINDING WIRE COILS

[76] Inventor: John Hill, Walden, Parkfields La., Fearnhead Nr. Warrington, England

[21] Appl. No.: 860,414

[22] Filed: Dec. 13, 1977

[51] Int. Cl.[2] ..... B65H 75/22; B65H 75/24

[52] U.S. Cl. ..... 242/110.2; 242/71.9; 242/77; 242/115

[58] Field of Search ..... 242/115, 110.2, 110.1, 242/77, 77.4

[56] References Cited

U.S. PATENT DOCUMENTS

| | | | |
|---|---|---|---|
| 579,488 | 3/1897 | Lord | 242/110.3 |
| 1,062,493 | 5/1913 | Morton | 242/110.1 |
| 2,270,064 | 1/1942 | Littell | 242/110.2 |
| 2,649,260 | 8/1913 | Beneke | 242/115 |
| 2,971,721 | 2/1961 | Jones | 242/115 X |

FOREIGN PATENT DOCUMENTS

| | | | |
|---|---|---|---|
| 2231483 | 1/1974 | Fed. Rep. of Germany | 242/110.1 |
| 2256665 | 7/1975 | France | 242/110.2 |
| 2263972 | 10/1975 | France | 242/110.2 |
| 651809 | 4/1951 | United Kingdom | 242/110.2 |

*Primary Examiner*—George F. Mautz
*Attorney, Agent, or Firm*—William A. Drucker

[57] ABSTRACT

A reel for use in making coils of wire and the like comprises a drum having two end flanges at least one of the flanges being detachable for removal of the coil from the drum which is itself formed of an assembly of segments radially displaceable between an expanded position for winding of a coil and contracted position for removal of the coil. The assembly includes slots in one end thereof and one of the flanges has spokes and is adjustable axially relative to the drum for setting the effective winding width to any one of a number of different sizes. The reel further comprises a support member located inwardly of the spoked flange to support each segment for radial displacement, the arrangement being such that during axial movement of the one end flange the spokes are accommodated in the slots in the assembly of segments. A modification of the reel provides also for adjustment of the effective diameter of the drum, in its expanded position, so that coils of different internal diameter can be wound using the same reel.

17 Claims, 5 Drawing Figures

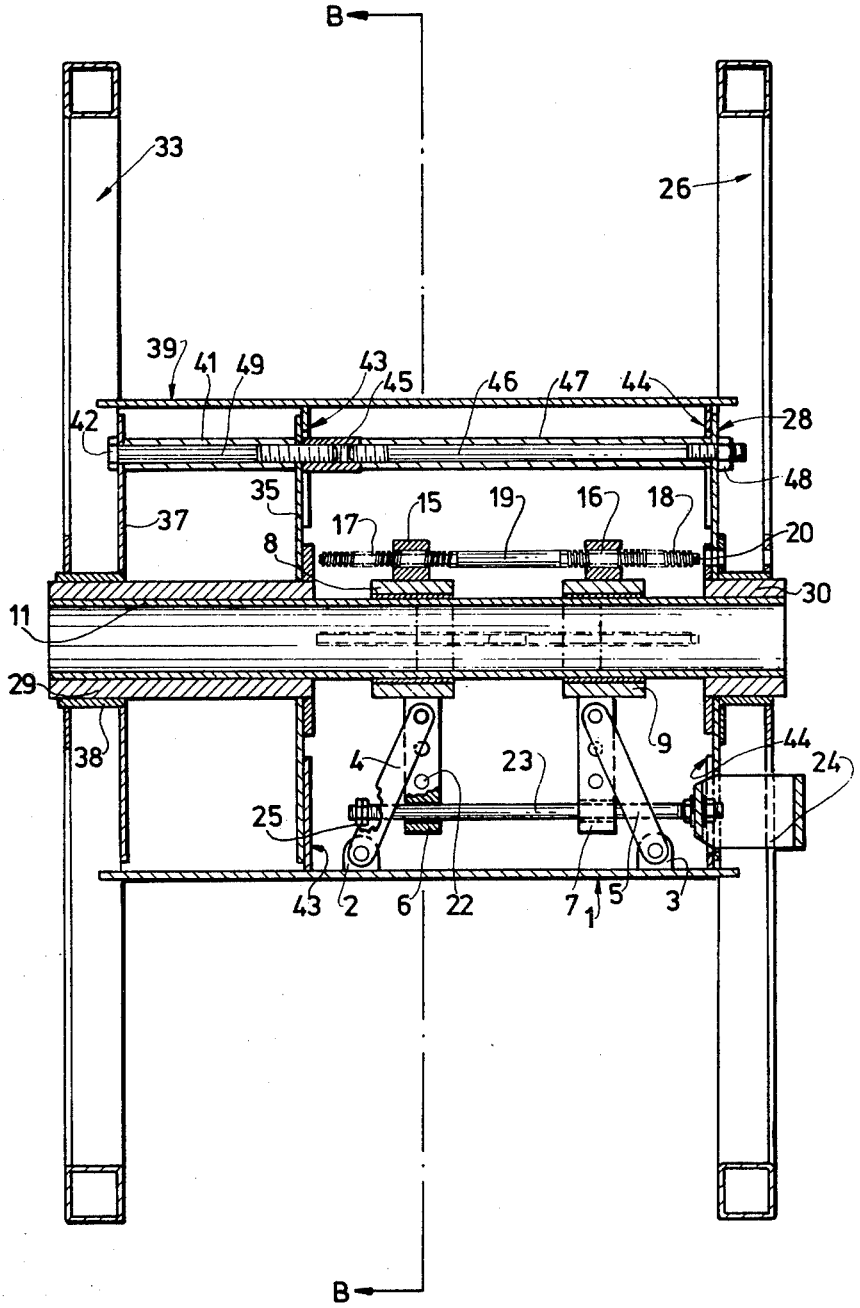
—FIG.1—

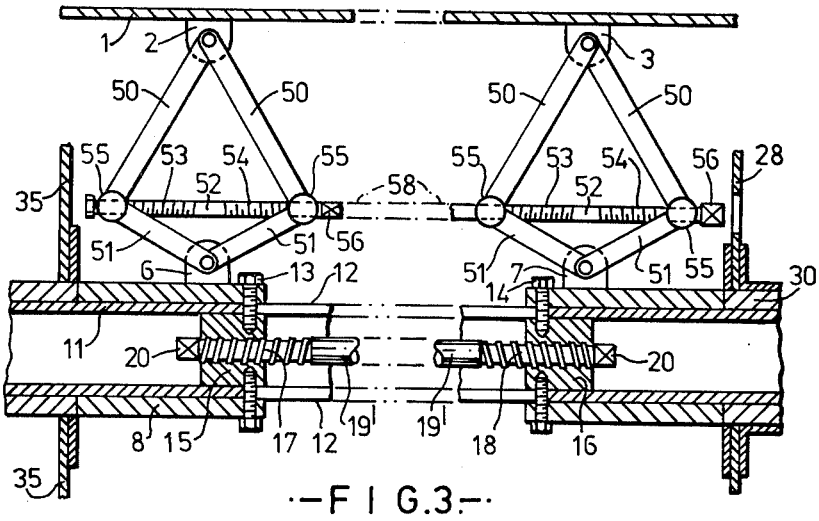
·—F I G.3.—·
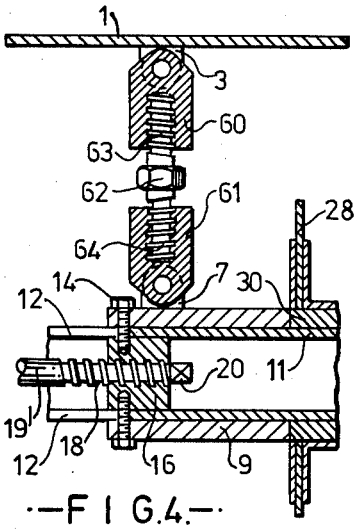
·—F I G.4.—·
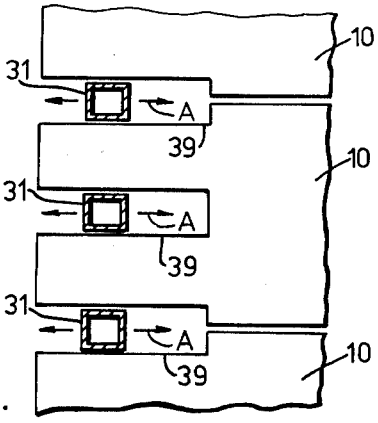
·—F I G.1a.—·

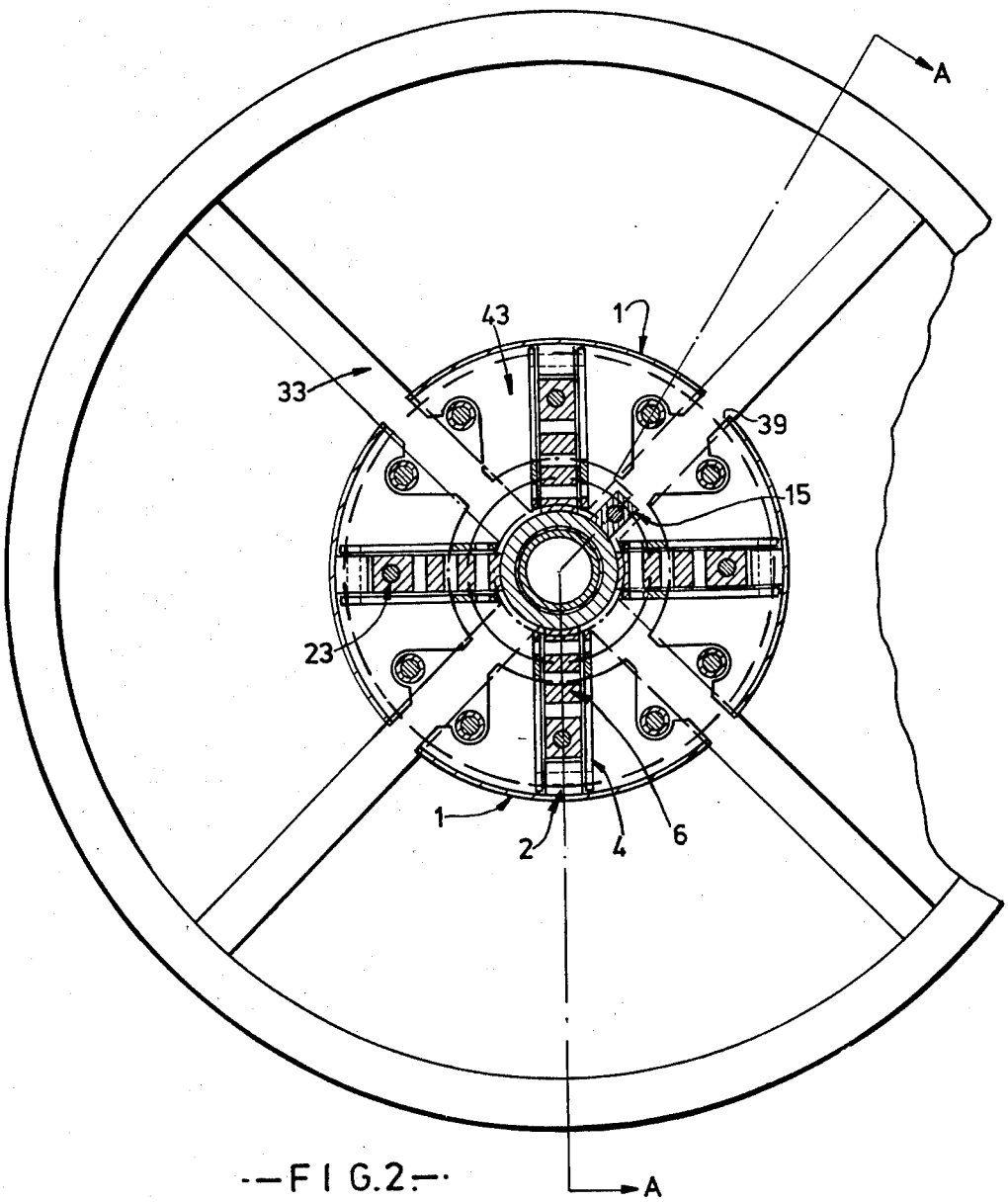
-- FIG.2 --

ADJUSTABLE REEL FOR WINDING WIRE COILS

The present invention relates to reels for use in making loose coils or "cheeses" of cable, wire, or wire rope, hereinafter termed wire.

The invention is particularly applicable to reels comprising a drum or barrel having two ends flanges one at least of which is detachable for removal of the coil from the drum. As provided herein a preferred drum is formed of segments each radially displaceable between expanded and contracted positions by means within the drum to facilitate removal of the coil. With such a reel it is readily possible to wind a cheese of wire on the reel and, when winding is completed, contract the drum or barrel of the reel and remove one end flange to release the cheese for despatch in reel-less form. However, whilst the radial thickness of the cheese can be varied simply by varying the length of wire wound, it has been necessary to use separate reels of different dimensions in order to produce cheeses of different axial extent.

It is an object of the invention to overcome this drawback and provide a reel of the type preferred herein which can be adjusted dimensionally so that a single reel can serve equally well in the production of a variety of different sized cheeses.

According to the present invention there is provided a reel for use in making coils of wire and the like comprising a drum having two end flanges at least one of said flanges being detachable from the drum for removal of the coil from the drum, wherein the drum being formed of an assembly of segments radially displaceable between an expanded position for winding of a coil and a contracted position said assembly including slots in one end thereof, means within the drum operable to displace the segments between said expanded and contracted positions, one of said flanges having spokes and being mounted for adjustment axially relative to the drum for setting the effective winding width to any one of a number of different sizes, the reel further comprising a support member located inwardly of the said spoked flange to support each said segment for said radial displacement, the arrangement being such that during axial movement of the one end flange said spokes are accommodated in said slots in said assembly of segments. The support member conveniently comprises a circular plate, located intermediate the end flanges and extending radially of the drum axis. The slots may be formed by stepped edge portions of adjacent segments. The segments may also be supported by a further support member disposed adjacent the non-adjustable flange of the reel, conveniently secured to the first member by tie bars extending therebetween.

It is desirable to be able to wind coils of different internal diameter using the same reel and to this end the reel may be modified by making the segments adjustable radially so that the effective winding diameter of the reel can be set to anyone of a number of different sizes.

In preferred embodiments the radial adjustment of the segments is achieved by varying the effective length of link means pivotally connected between each said segment and holding means in a fixed plane, said means for displacing the drum segments being arranged to effect relative radial displacement of the ends of the link means so as to cause movement of the segments between the expanded and contracted positions. Preferably the holding means includes a pair of bosses the link means includes a pair of linkages for each segment pivotally connected at their radially inner ends to respective sliding bosses which are arranged to be moved towards and away from each other by means operable from outside the reel.

Movement of the sliding bosses is conveniently effected by a rod oppositely screw-threaded at its opposite ends each of which engages a corresponding threaded part of the respective boss. However, this rod could be replaced, if so desired, by pneumatic, hydraulic or electric means. The or each linkage may comprise on the boss an arm having a series of radially spaced holes for selective pivotal attachment thereto of a link enabling stepwise variation of the effective winding diameter by selection of different holes.

Embodiments of the invention may provide for continuously variable setting of the effective winding diameter preferably by means of a pair of arms both pivotally secured at their radially outer ends to the segment and each pivotally attached to a respective one of a second pair of arms the innermost ends of both of which are pivotally secured to the holding means, e.g. sliding bosses, for displacing the segments, the pivots connecting the different pairs of arms being movable relative to each other by adjustment means operable from outside the drum. This adjustment means conveniently comprises a screw-threaded member oppositely handed at end portions each engaging a respective nut secured to or integral with a corresponding one of the pivots.

Where pairs of continuously variable linkages are provided on each segments it is preferably that they be adjustable simultaneously. For example, where the adjustment means comprises a screw-threaded member these could be coupled together telescopically or flexibly.

The screw-threaded members for adjusting the linkages could, if desired, also be replaced by pneumatic, hydraulic or electric means.

The various features and advantages of the invention will be apparent from the following description of an exemplary embodiment illustrated in the accompanying drawings of which:

FIG. 1 is an axial section of a reel according to the invention embodying both axial and radial adjustment arrangements, FIG. 1*a* is a developed partial view of one end of the reel in FIG. 1.

FIG. 2 is a cross-section of the reel of FIG. 1 taken on the section line B—B of FIG. 1, and FIGS. 3 and 4 illustrate modifications of the diameter adjusting means of FIGS. 1 and 2.

The sectional view of FIG. 1 is taken on the line A—A of FIG. 2 and shows a reel having a drum 1 flanked at opposite ends by end flanges 26 and 33. The drum 1 is made up of a number of drum segments 10 each having an inwardly directed flange 44 close to the end adjacent flange 26 and another inwardly directed flange 43 spaced inwardly from the end adjacent flange 33. The axle of the drum is constituted by a tube 11 on opposite ends of which are carried bosses 29 and 30 from which circular support plates 35 and 28 extend radially outwardly. The support plate 28 is provided at intervals around its outer periphery with holes to receive tie bars and the plate 35 has corresponding holes around each of which extends an internally screw-threaded tubular boss 45 directed axially of the drum towards plate 28. A tie bar 46, screw-threaded at each of its opposite ends, engages in each boss 45, passes through a tubular distance piece 47 and through one of the holes in plate 28 to engage a nut 48 at the outer face of plate 28. Each distance piece 47, when the corresponding nut 48 is tightened on the thread of its bar 46, extends between the inner face of plate 28 and the confronting end face of a boss 45 so that the plates 28 and 35 are held a fixed distance apart at a number of points around the periphery of such plates. The flanges 43 and 44 are slotted to pass about the bosses 45 and distance pieces 47 to permit radial displacement of the drum segments relative to parts 45 and 47 and the spacing between flanges 43 and 44 is such that they abut confronting faces of the support plates 35 and 28 respectively.

The end flange 33 has four spokes 31 extending from a hub 38 which is a sliding fit on boss 29. Hub 38 has a radially outwardly extending flange 37 provided with holes which can be brought into register with the holes in plates 28 and 35 and the segments 10 of the drum 1 are stepped at their end edge portions to define axial slots 39 to accommodate spokes of the end flange 33 and so allow it to be slid along boss 29 as indicated by arrows A in FIG. 1*a*. between an outer extreme position as shown in FIG. 1 and an inner extreme position in which flange 37 abuts plate 35. In order to secure end flange 33 in a chosen position between these extremes a set of threaded tie rods 49 with corresponding tubular distance pieces 41, of appropriate length is selected and the rods passed through the holes in flanges 37 and through the distance pieces 41 to engage in the bores of bosses 45 and nuts 42 applied to the outer ends of rods 49. As an alternative to the use of nuts 42 the rods 49 may be in the form of headed bolts. Preferably the bosses 45 are screw-threaded opposite handedly inwardly from each end.

By means of the above described measures the effective axial length, for winding purposes, of the drum 1 can be adjusted between the extremes referred to without demounting the segments or flange 33 from the axle of the reel simply by removing one set of rods 49 and distance pieces 41 and replacing them with another set chosen to give the desired axial length. For the minimum length position no distance pieces 41 are required, the flange 37 in this case being bolted directly into the bosses 45.

For the purpose of contracting the drum to release a wound cheese tubular sleeves 8 and 9 are slidably mounted on tube 11, the sleeves 8 and 9 carrying lugs 15 and 16 each having an internally screw-threaded bore in which engages a rod 19 having left and right handed screw threads 17 and 18 on opposite sides of its centre and a squared end 20 by means of which the rod 19 may be rotated to cause lugs 15 and 16 and thus sleeves 8 and 9 to move towards and away from each other. The sleeves 8 and 9 also carry arms 6 and 7, one for each segment of drum 1 each having a series of radially spaced holes 22 for the pivotal attachment thereto of the inner end of a link 4 and 5, the outer ends of such links being pivotally attached to inward facing lugs 2, 3 on the inner faces of the segments 10 of drum 1. Thus as the sleeves 8 and 9 are moved towards each other the drum segments are drawn inwardly by the links 5 and the effective diameter of the drum is decreased. Conversely as the sleeve 8 and 9 move apart the drum is expanded.

Each of the arms 6 and 7 is of bifurcated form and a rod 23 passes between the bifurcations of each pair of these arms. At one end rod 23 carries a nut 25 which serves as an end stop to limit movement of sleeves 8 and 9 and at its other end it is secured to a U-shaped clamp 24.

Each substantially U-shaped clamp 24 is adapted for embracing engagement with two sides of a radial spoke of the detachable drum end flange 26 the end of each clamp rod 23 being connected to one limb of the clamp 24, as distinct from the web between the limbs. The dimension of the web of each clamp 24 is greater than the width of that side of a spoke with which it is required to engage by at least the thickness of the plate 28 which is slotted to allow the passage therethrough of the outer limb and part of the web of each clamp.

In operation, and with the barrel set in its expanded state to the required winding diameter, wire on manufacture there of is wound around the barrel. Standard steel straps or ties are then applied through strapping guides provided to facilitate passing under the coil and are secured firmly round the coil in the usual manner by standard strapping tools. To separate the "loose" and strapped coil from the drum for despatch to a customer or user, the screw-threaded rod 19 is rotated and, through the medium of the linkage 4, 5 the barrel segments 1 are retracted and the clamps on the spokes of the dismountable drum end flange 26 removed from their operative engagement with the spokes of such flange enabling the spokes to become clear of the plate 28 secured to the boss 30 by slightly twisting the flange with respect to the clamps. On withdrawal of the drum end or flange as a whole from the retracted barrel the coil of wire may be removed from said barrel.

Reassembly after removal of a wire coil merely involves a reversal of the operation, the dismountable flange being applied to the boss by sliding it thereon and then being twisted until the spokes are located under the ends of their respective clamps, whereupon the screwed rod is rotated in the reverse direction to displace the clamps into their gripping positions on the spokes simultaneously with the arrival of the barrel segments at their expanded positions.

It will be appreciated that should one or more clamps 24 fail adequately to grip their respective spokes when the other clamps have tightly engaged their spokes, the required adjustment to enable all the clamps to grip their respective spokes in the desired tight manner may be effected simply by tightening the lock nuts 25 at the opposite ends of the clamp rods.

By selecting different sets of the holes 22 for attaching the inner ends of links 4 and 5 to arms 6 and 7 different initial winding diameters of drum 1 can be achieved.

The set of holes 22 in each of the arms 6 and 7 provides for a stepwise adjustment of the diameter of the drum 1 formed by segments 10 but if an infinitely variable type of adjustment is required the arms may be shortened in radial length and each provided with only one hole 22 and the links 4 and 5 replaced by the type of link means shown in FIGS. 3 or 4.

In the arrangement of FIG. 3 the links 4 and 5 are each replaced by an adjustable linkage comprising a pair of longer arms 50 both pivotally attached at their outer ends to a lug 2 or 3, and each pivotally attached at its inner end to one of a pair of shorter arms 51 the innermost ends of both of which are pivotally attached to a lug 6 or 7. In this embodiment, and that of FIG. 4, the lugs 6 or 7 are substantially identical to lugs 2 and 3. For infinitely variable adjustment of the linkage 50, 51, a lefthand/righthand screw-threaded bolt 52 engages in nuts such as 57 secured to or integral with pivot members 55 at each junction of an arm 50 with an arm 51, the thread 53 of one hand co-operating with the nut of one pivot member 55 and the thread 54 of the opposite hand co-operating with the nut of the other pivot member 55. Upon rotation of the head 56 of bolt 52 the members 55 are moved towards or away from each other to expand and contract the drum 1.

In FIG. 3, a flexible coupling 58 is provided to couple the rods 52 of the pairs of linkages for simultaneous adjustment of both ends of the segment. Clearly other coupling arrangements, e.g. telescopic might be used instead.

In the arrangement of FIG. 4 the links 4 and 5 are replaced by internally screw-threaded sleeves 60 and 61 each pivotally secured at one end to a lug 2 or 3 or a lug 6 or 7 and receiving into its threaded interior from the opposite end a bolt formed with an operating nut 62 at its centre and screw-threaded portions 63 and 64 of opposite hands extending to opposite ends thereof. Rotation of the nut 62 and thus of the bolt itself causes expansion or contraction of the drum 1.

The infinitely variable adjustment provided in the embodiments of FIGS. 3 and 4 may be supplemented by a stepwise adjustment by incorporating the feature of the arrangement of FIG. 1 of two or more holes in the lugs 2, 3 or 6, 7 to vary the pivotal attachment points of the linkages 50, 51 or the sleeves 60, 61.

In all the above-described embodiments the tube 10 may be longitudinally slotted at diametrically disposed parts 11, 12 over a mid-portion of its length to receive pairs of socket drive screws 13, 14 by which the sliding bosses 8, 9 are connected to left and right hand threaded nuts 15, 16 disposed on the threaded parts 17, 18 of rod 19' located inside the tube 10 which has squared end 20 to facilitate connection with means for rotating the rod inserted into the end of the tube 10.

The centre of the rod has a collar 21 which functions as a stop for limiting the inward axial displacement of the nuts 15, 16 on rotation of the rod 19 and thus the inward axial displacement of the inner ends of the link bars 4, 5 or their equivalents to a position of maximum retraction of the barrel segments 1. Relative displacement of the nuts in an outward direction axially of the rod beyond limits consistent with the links lying at right angles to said axis (representing the expanded position of the barrel segments) is prevented by bosses on the outer ends of the tube.

I claim:

1. A reel for use in making coils of wire and the like comprising a drum having two end flanges at least one of said flanges being detachable from the drum for removal of the coil from the drum, the drum being formed of an assembly of segments radially displaceable between an expanded position for winding of a coil and a contracted position for removal of the coil, said assembly including slots in one end thereof, means within the drum operable to displace the segments between said expanded and contracted positions one of said end flanges having spokes and being mounted for adjustment axially relative to the drum for setting the effective winding width to any one of a number of different sizes, the reel further comprising a support member located inwardly of the said spoked flange to support each said segment for said radial displacement, the arrangement being such that during axial movement of the one end flange said spokes are accommodated in said slots in said assembly of segments.

2. A reel as claimed in claim 1, wherein said means for displacing the segments includes link means pivotally connected between each said segment and holding means located in a fixed plane, said means for displacing the drum segments being arranged to effect relative axial displacement of one end of said link means so as to cause movement of said segments radially inwardly and outwardly in dependence upon the direction of such axial displacement and means operable for presetting the expanded position, said last means being operative to adjust the effective length of said link means to set the effective winding diameter of the reel.

3. A reel as claimed in claim 2, wherein said holding means includes a pair of bosses and said link means includes a pair of linkages having their radially outer ends pivotally connected to a respective segment and their radially inner ends each pivotally connected to a respective boss, the bosses being displaceable axially towards and away from each other, and means operable from outside the reel for displacing said bosses.

4. A reel as claimed in claim 3, wherein said means for displacing the sliding bosses comprises a rod oppositely screw-threaded at its opposite ends each of which ends engages a corresponding threaded part of the respective boss.

5. A reel as claimed in claim 3, wherein said means for presetting the expanded position comprises an arm projecting radially from each boss and having a series of radially spaced holes for selective pivotal attachment to the arm of a link of said linkage.

6. A reel as claimed in claim 2, wherein each said linkage comprises a pair of arms both pivotally secured at their radially outer ends relative to the segment and each pivotally attached to a respective one of a second pair of arms, the innermost ends of both of which arms of the second pair being pivotally secured relative to the means for displacing the segments, the means for presetting the expanded position being within the drum and operable to move the pivots connecting the different pair of arms relative to each other to adjust the effective length of the linkage, the means for presetting being operable from outside the drum and comprising a screw member having opposite end portions screwthreaded oppositely handed, each said end portion engaging a respective nut secured to or integral with a corresponding one of the pivots.

7. A reel as claimed in claim 3, wherein the means for presetting the expanded position includes common adjustment means operative to adjust the effective length of each linkage of said pair of linkages simultaneously.

8. A reel as claimed in claim 7, wherein the common adjustment means comprises a flexible coupling between each linkage of the pair of linkages.

9. A reel as claimed in claim 2, wherein the link means includes a pair of sleeves each having a threaded interior, one said sleeve being pivotally secured relative to the segment, the other sleeve of the pair being pivotally secured to the means for displacing the segments, each sleeve receiving into its threaded interior a corresponding end portion of a bolt having opposite end portions oppositely screw-threaded and having at its centre means whereby the bolt can be rotated.

10. A reel as claimed in claim 1, wherein said support member is located intermediate said end flanges and extends radially of the drum axis, each segment being supported by and displaceable radially relative to said support member.

11. A reel as claimed in claim 10, wherein edge portions of adjacent segments are stepped to define the slots therebetween.

12. A reel as claimed in claim 10, wherein the adjustable end flange is secured to the support member by a plurality of tie bars of predetermined length disposed around the drum axis.

13. A reel as claimed in claim 12, wherein the support member has a number of internally screw-threaded bosses, each tie bar being correspondingly screw-threaded at its end to engage such a boss.

14. A reel as claimed in claim 10, including a second support member disposed adjacent that flange of the reel opposed to the adjustable flange, each drum segment being further supported by and displaceable radially relative to said second support member.

15. A reel as claimed in claim 14, wherein the support members are secured together by a plurality of tie bars extending therebetween and disposed around the drum axis.

16. A reel as claimed in claim 15, wherein each drum segment has an inwardly directed flange close to each support member, each flange having radially extending slots at intervals to accommodate the tie bars.

17. A reel as claimed in claim 1 including additional means operable to preset the expanded position of the segments to correspond to any one of a number of different effective winding diameters.

* * * * *